US011670853B2

(12) United States Patent
Wang et al.

(10) Patent No.: US 11,670,853 B2
(45) Date of Patent: Jun. 6, 2023

(54) ANTENNA STRUCTURE

(71) Applicant: Wistron Corp., New Taipei (TW)

(72) Inventors: Yu-Liang Wang, New Taipei (TW); Yu-Chia Chang, New Taipei (TW); Jung-Chin Hsieh, New Taipei (TW); Wen-Chieh Wu, New Taipei (TW)

(73) Assignee: WISTRON CORP., New Taipei (TW)

( * ) Notice: Subject to any disclaimer, the term of this patent is extended or adjusted under 35 U.S.C. 154(b) by 184 days.

(21) Appl. No.: 17/208,243

(22) Filed: Mar. 22, 2021

(65) Prior Publication Data

US 2022/0255226 A1 Aug. 11, 2022

(30) Foreign Application Priority Data

Feb. 9, 2021 (TW) ..... 110104923

(51) Int. Cl.
*H01Q 5/307* (2015.01)
*H01Q 1/48* (2006.01)
(Continued)

(52) U.S. Cl.
CPC ..... *H01Q 5/307* (2015.01); *H01Q 1/38* (2013.01); *H01Q 1/48* (2013.01); *H01Q 1/243* (2013.01)

(58) Field of Classification Search
CPC ..... H01Q 1/241; H01Q 1/242; H01Q 1/243; H01Q 1/2266; H01Q 1/36; H01Q 1/38;
(Continued)

(56) References Cited

U.S. PATENT DOCUMENTS 6,906,678 B2 * 6/2005 Chen ..... H01Q 1/243 343/700 MS
8,866,689 B2 * 10/2014 Islam ..... H01Q 21/30 343/810

(Continued)

FOREIGN PATENT DOCUMENTS

| | | |
|---|---|---|
| CN | 208548451 U | 2/2019 |
| TW | 200414603 A | 8/2004 |
| TW | 200835055 A | 8/2008 |

OTHER PUBLICATIONS

Chinese language office action dated Sep. 13, 2021, issued in application No. TW 110104923.

(Continued)

*Primary Examiner* — Ab Salam Alkassim, Jr.
*Assistant Examiner* — Leah Rosenberg
(74) *Attorney, Agent, or Firm* — McClure, Qualey & Rodack, LLP

(57) ABSTRACT

An antenna structure includes a ground element, a dielectric substrate, a first radiation element, a second radiation element, a third radiation element, a fourth radiation element, a fifth radiation element, a sixth radiation element, and a seventh radiation element. The dielectric substrate has a first surface and a second surface. The first radiation element and the third radiation element are coupled to a first feeding point. The second radiation element and the fourth radiation element are coupled to the ground element. The first radiation element, the second radiation element, the third radiation element, and the fourth radiation element are on the first surface. The fifth radiation element is coupled to a second feeding point. The sixth radiation element and the seventh radiation element are coupled to the fifth radiation element. The fifth radiation element, the sixth radiation element, and the seventh radiation element are on the second surface.

20 Claims, 18 Drawing Sheets

(51) Int. Cl.
*H01Q 1/38* (2006.01)
*H01Q 1/24* (2006.01)

(58) Field of Classification Search
CPC ..... H01Q 5/328; H01Q 5/35; H01Q 5/364; H01Q 5/371; H01Q 5/40; H01Q 9/26; H01Q 9/42; H01Q 21/28; H01Q 21/30
See application file for complete search history.

(56) References Cited

U.S. PATENT DOCUMENTS

| | | | | |
|---|---|---|---|---|
| 10,542,130 | B1 * | 1/2020 | Lo | H04M 1/026 |
| 2008/0278380 | A1 * | 11/2008 | Miyoshi | H01Q 1/38 343/700 MS |
| 2012/0133571 | A1 * | 5/2012 | Collins | H01Q 1/242 343/860 |
| 2015/0120189 | A1 * | 4/2015 | Giometti | H04W 72/0453 342/450 |
| 2016/0294048 | A1 * | 10/2016 | Xu | H01Q 1/2291 |
| 2017/0093019 | A1 * | 3/2017 | Toh | H01Q 9/0407 |
| 2017/0317412 | A1 * | 11/2017 | Wu | H01Q 21/30 |
| 2018/0191057 | A1 * | 7/2018 | Chen | H01Q 1/243 |

OTHER PUBLICATIONS

Shen, Y.C.; "Printed Triple-Band Antenna Utilizing Modified Open-Loop and Switched Beam Antenna for Wireless Communication Applications"; Jul. 2006; pp. 1-94.
English language translation of "Printed Triple-Band Antenna Utilizing Modified Open-Loop and Switched Beam Antenna for Wireless Communication Applications"; Jul. 2006; pp. 1-94.

* cited by examiner

ANTENNA STRUCTURE

CROSS REFERENCE TO RELATED APPLICATIONS

This application claims priority of Taiwan Patent Application No. 110104923 filed on Feb. 9, 2021, the entirety of which is incorporated by reference herein.

BACKGROUND OF THE INVENTION

Field of the Invention

The disclosure generally relates to an antenna structure, and more particularly, it relates to an almost omnidirectional antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has a narrow beamwidth and small coverage, it will negatively affect the communication quality of the mobile device. Accordingly, it has become a critical challenge for designers to design an almost omnidirectional antenna structure.

BRIEF SUMMARY OF THE INVENTION

In an exemplary embodiment, the disclosure is directed to an antenna structure that includes a ground element, a dielectric substrate, a first radiation element, a second radiation element, a third radiation element, a fourth radiation element, a fifth radiation element, a sixth radiation element, and a seventh radiation element. The dielectric substrate has a first surface and a second surface which are opposite to each other. The first radiation element has a first feeding point. The second radiation element is coupled to the ground element. The third radiation element is coupled to the first feeding point. The fourth radiation element is coupled to the ground element. The first radiation element, the second radiation element, the third radiation element, and the fourth radiation element are disposed on the first surface of the dielectric substrate. The fifth radiation element has a second feeding point. The sixth radiation element is coupled to the fifth radiation element. The seventh radiation element are coupled to the fifth radiation element. The fifth radiation element, the sixth radiation element, and the seventh radiation element are on the second surface of the dielectric substrate.

In some embodiments, the antenna structure further includes a signal source and a switch circuit. The switch circuit couples the signal source to the first feeding point or the second feeding point according to a control signal.

In some embodiments, the third radiation element and the fourth radiation element are positioned between the first radiation element and the second radiation element.

In some embodiments, the antenna structure covers a first frequency band, a second frequency band, and a third frequency band. The first frequency band is from 2400 MHz to 2500 MHz. The second frequency band is from 5150 MHz to 5850 MHz. The third frequency band is from 5925 MHz to 7125 MHz.

In some embodiments, the first radiation element substantially has a J-shape. The length of the first radiation element is from 0.25 to 0.3 wavelength of the first frequency band.

In some embodiments, the second radiation element substantially has an inverted J-shape. The length of the second radiation element is from 0.25 to 0.3 wavelength of the first frequency band.

In some embodiments, the distance between the first radiation element and the second radiation element is shorter than 0.25 wavelength of the first frequency band.

In some embodiments, the third radiation element substantially has a C-shape. The length of the third radiation element is from 0.25 to 0.3 wavelength of the second frequency band.

In some embodiments, the fourth radiation element substantially has an inverted C-shape. The length of the fourth radiation element is from 0.25 to 0.3 wavelength of the second frequency band.

In some embodiments, the sixth radiation element substantially has a U-shape. The total length of the fifth radiation element and the sixth radiation element is from 0.2 to 0.25 wavelength of the first frequency band.

In some embodiments, the sixth radiation element further includes a first widening portion.

In some embodiments, the seventh radiation element substantially has an L-shape. The total length of the fifth radiation element and the seventh radiation element is substantially equal to 0.3 wavelength of the second frequency band.

In some embodiments, the seventh radiation element further includes a second widening portion.

In some embodiments, the sixth radiation element substantially has an L-shape. The total length of the fifth radiation element and the sixth radiation element is substantially equal to 0.2 wavelength of the first frequency band.

In some embodiments, the seventh radiation element substantially has a straight-line shape. The total length of the fifth radiation element and the seventh radiation element is substantially equal to 0.2 wavelength of the second frequency band.

In some embodiments, the antenna structure further includes an eighth radiation element, a ninth radiation element, and a tenth radiation element. The eighth radiation element has a third feeding point. The ninth radiation element is coupled to the eighth radiation element. The tenth radiation element is coupled to the eighth radiation element. The eighth radiation element, the ninth radiation element, and the tenth radiation element are disposed on the second surface of the dielectric substrate.

In some embodiments, the antenna structure further includes a signal source and a switch circuit. The switch circuit couples the signal source to the first feeding point, the second feeding point, or the third feeding point according to a control signal.

In some embodiments, the ninth radiation element substantially has a U-shape. The total length of the eighth radiation element and the ninth radiation element is from 0.2 to 0.25 wavelength of the first frequency band.

In some embodiments, the tenth radiation element substantially has an L-shape. The total length of the eighth radiation element and the tenth radiation element is substantially equal to 0.3 wavelength of the second frequency band.

In some embodiments, the tenth radiation element further includes a first widening portion and a second widening portion.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
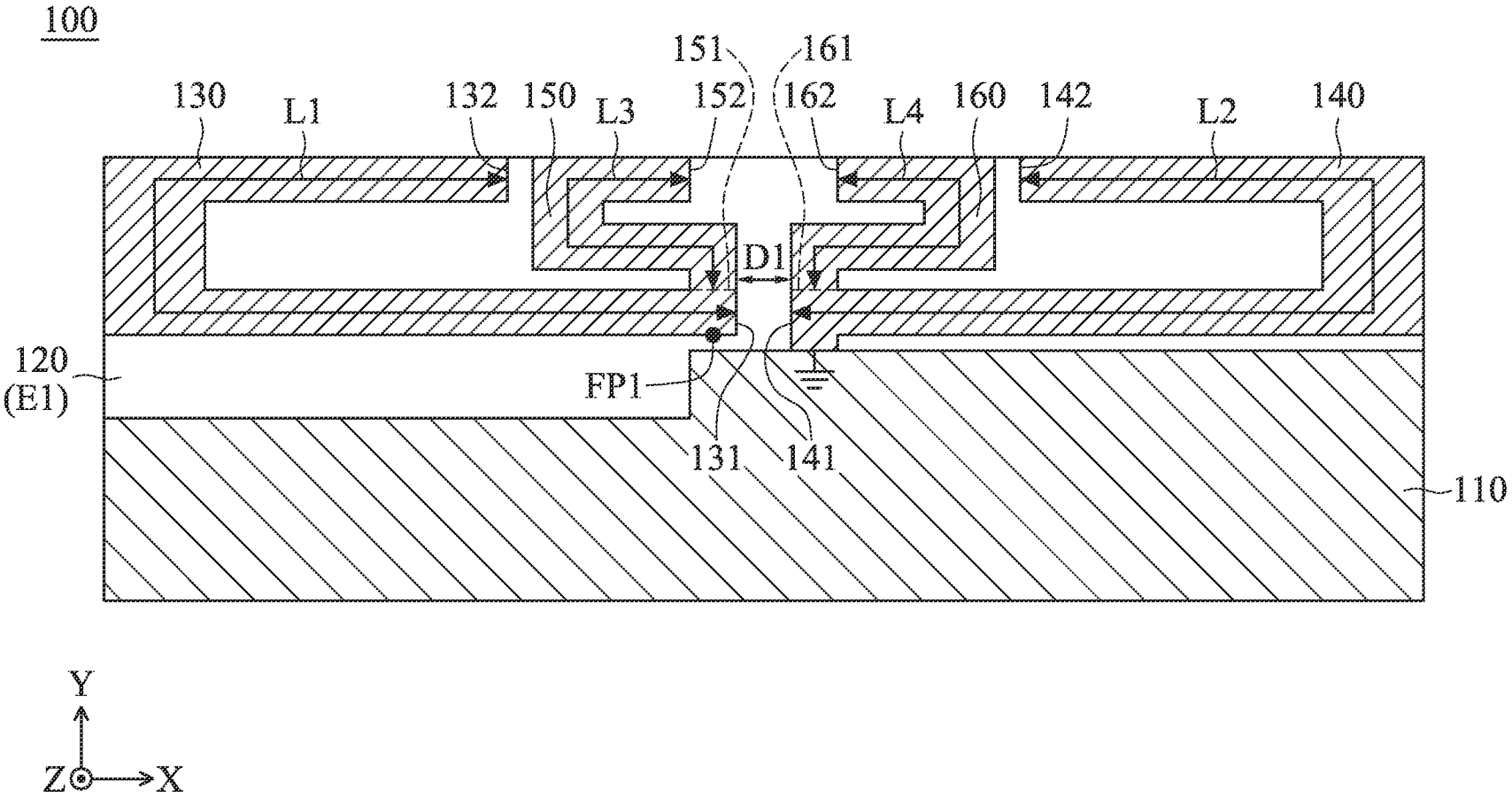
FIG. 1A is a top view of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1A is a top view of an antenna structure 100 according to an embodiment of the invention. The antenna structure 100 may be applied to a mobile device, such as a smartphone, a tablet computer, a notebook computer, a wireless access point, a display device, a router, or any device for communication. As shown in FIG. 1A, the antenna structure 100 includes a ground element 110, a dielectric substrate 120, a first radiation element 130, a second radiation element 140, a third radiation element 150, a fourth radiation element 160, a fifth radiation element 210, a sixth radiation element 220, and a seventh radiation element 230. The ground element 110, the first radiation element 130, the second radiation element 140, the third radiation element 150, the fourth radiation element 160, the fifth radiation element 210, the sixth radiation element 220, and the seventh radiation element 230 may all be made of metal materials, such as silver, copper, aluminum, iron, or their alloys.

Figure 1B:
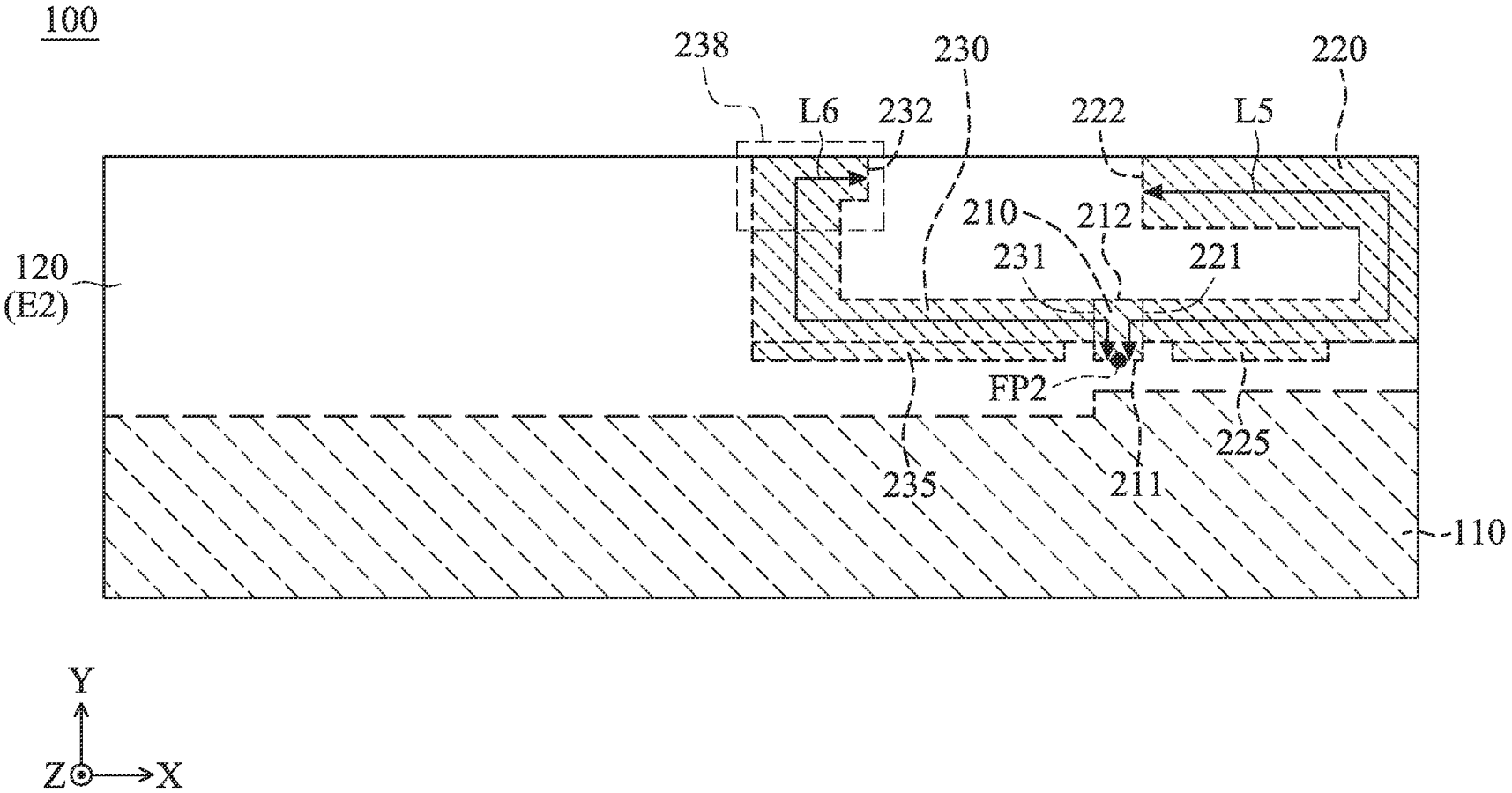
FIG. 1B is a see-through view of an antenna structure according to an embodiment of the invention.
Figure 1C:
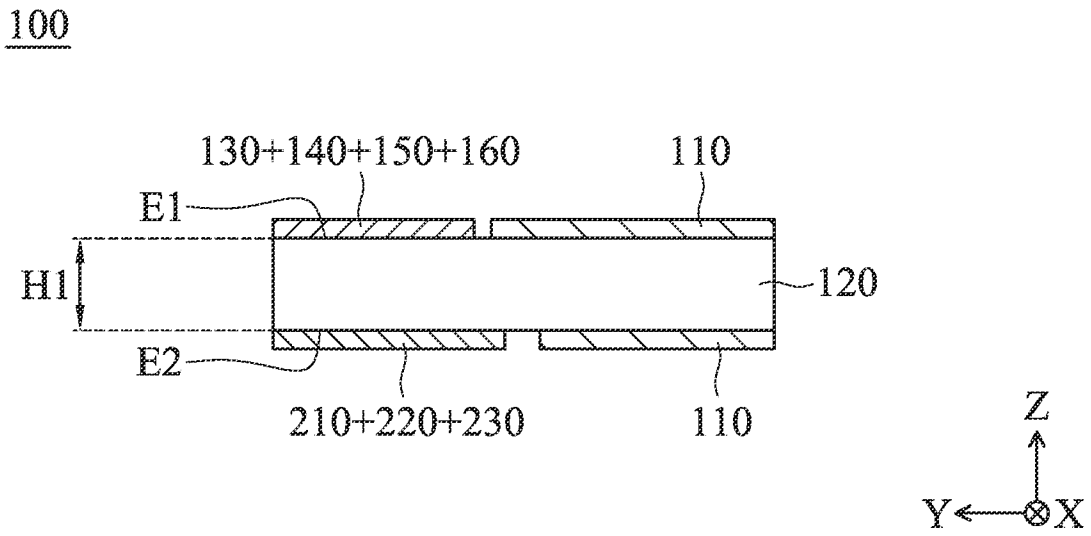
FIG. 1C is a side view of an antenna structure according to an embodiment of the invention.

The dielectric substrate 120 may be an FR4 (Flame Retardant 4) substrate, a PCB (Printed Circuit Board), or an FPC (Flexible Printed Circuit). The dielectric substrate 120 has a first surface E1 and a second surface E2 which are opposite to each other. The first radiation element 130, the second radiation element 140, the third radiation element 150, and the fourth radiation element 160 may all be disposed on the first surface E1 of the dielectric substrate 120. The fifth radiation element 210, the sixth radiation element 220, and the seventh radiation element 230 may all be disposed on the second surface E2 of the dielectric substrate 120. In addition, the ground element 110 may be implemented with a ground copper foil, which may extend onto both of the first surface E1 and the second surface E2 of the dielectric substrate 120. FIG. 1B is a see-through view of the antenna structure 100 according to an embodiment of the invention (i.e., the dielectric substrate 120 is considered as a transparent element, and all of the elements disposed on its first surface E1 are omitted and not shown). FIG. 1C is a side view of the antenna structure 100 according to an embodiment of the invention. Please refer to FIG. 1A, FIG. 1B, and FIG. 1C to understand the invention.

The first radiation element 130 may substantially have a J-shape. Specifically, the first radiation element 130 has a first end 131 and a second end 132. A first feeding point FP1 is positioned at the first end 131 of the first radiation element 130. The second end 132 of the first radiation element 130 is an open end.

The second radiation element 140 may substantially have an inverted J-shape, which may be considered as a mirrored image of the first radiation element 130. Specifically, the second radiation element 140 has a first end 141 and a second end 142. The first end 141 of the second radiation element 140 is coupled to the ground element 110. The second end 142 of the second radiation element 140 is an open end. For example, the second end 142 of the second radiation element 140 and the second end 132 of the first radiation element 130 may extend toward each other.

The third radiation element 150 may substantially have a C-shape. Specifically, the third radiation element 150 has a first end 151 and a second end 152. The first end 151 of the third radiation element 150 is coupled to the first end 131 of the first radiation element 130 and the first feeding point FP1. The second end 152 of the third radiation element 150 is an open end.

The fourth radiation element 160 may substantially have an inverted C-shape, which may be considered as a mirrored image of the third radiation element 150. Specifically, the fourth radiation element 160 has a first end 161 and a second end 162. The first end 161 of the fourth radiation element 160 is coupled to the first end 141 of the second radiation element 140 and the ground element 110. The second end 162 of the fourth radiation element 160 is an open end. For example, the second end 162 of the fourth radiation element 160 and the second end 152 of the third radiation element 150 may extend toward each other. It should be noted that both of the third radiation element 150 and the fourth radiation element 160 are positioned between the first radiation element 130 and the second radiation element 140. Such a design can help to reduce the whole size of the antenna structure 100.

The fifth radiation element 210 may substantially have a straight-line shape. Specifically, the fifth radiation element 210 has a first end 211 and a second end 212. A second feeding point FP2 is positioned at the first end 211 of the fifth radiation element 210.

The sixth radiation element 220 may substantially have a U-shape. Specifically, the sixth radiation element 220 has a first end 221 and a second end 222. The first end 221 of the sixth radiation element 220 is coupled to the second end 212 of the fifth radiation element 210. The second end 222 of the sixth radiation element 220 is an open end. In some embodiments, the sixth radiation element 220 further includes a first widening portion 225, which may substantially have a long, thin rectangular shape and may be adjacent to the second feeding point FP2. Thus, the sixth radiation element 220 may be a variable-width structure. It should be noted that the term "adjacent" or "close" over the disclosure means that the distance (spacing) between two corresponding elements is shorter than a predetermined distance (e.g., 5 mm or shorter), but often it does not mean that the two corresponding elements are touching each other directly (i.e., the aforementioned distance/spacing therebetween is reduced to 0). Furthermore, the second radiation element 140 has a vertical projection on the second surface E2 of the dielectric substrate 120, and the vertical projection of the second radiation element 140 at least partially overlaps the fifth radiation element 210 and the sixth radiation element 220.

The seventh radiation element 230 may substantially have an L-shape. Specifically, the seventh radiation element 230 has a first end 231 and a second end 232. The first end 231 of the seventh radiation element 230 is coupled to the second end 212 of the fifth radiation element 210. The second end 232 of the seventh radiation element 230 is an open end. In some embodiments, the seventh radiation element 230 further includes a second widening portion 235, which may substantially have a long, thin rectangular shape and may be adjacent to the second feeding point FP2. Thus, the seventh radiation element 230 may be a variable-width structure. Furthermore, the fourth radiation element 160 has a vertical projection on the second surface E2 of the dielectric substrate 120, and the vertical projection of the fourth radiation element 160 at least partially overlaps the seventh radiation element 230. In some embodiments, the seventh radiation element 230 further includes a terminal bending portion 238, which is adjacent to the second end 232 of the seventh radiation element 230. For example, the second end 232 of the seventh radiation element 230 and the second end 222 of the sixth radiation element 220 may extend toward each other.

Figure 1D:
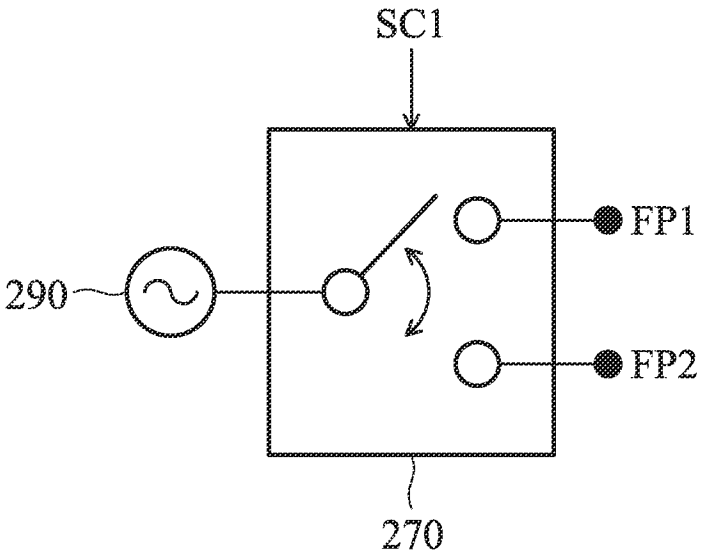
FIG. 1D is a diagram of a switch circuit and a signal source according to an embodiment of the invention.

FIG. 1D is a diagram of a switch circuit 270 and a signal source 290 according to an embodiment of the invention. In the embodiment of FIG. 1D, the antenna structure 100 further includes the switch circuit 270 and the signal source 290. For example, the signal source 290 may be an RF (Radio Frequency) module for exciting the antenna structure 100. The switch circuit 270 can couple the signal source 290 to either the first feeding point FP1 or the second feeding point FP2 according to a control signal SC1. The control signal SC1 may be generated by a processor according to a user's input (not shown).

Figure 2A:
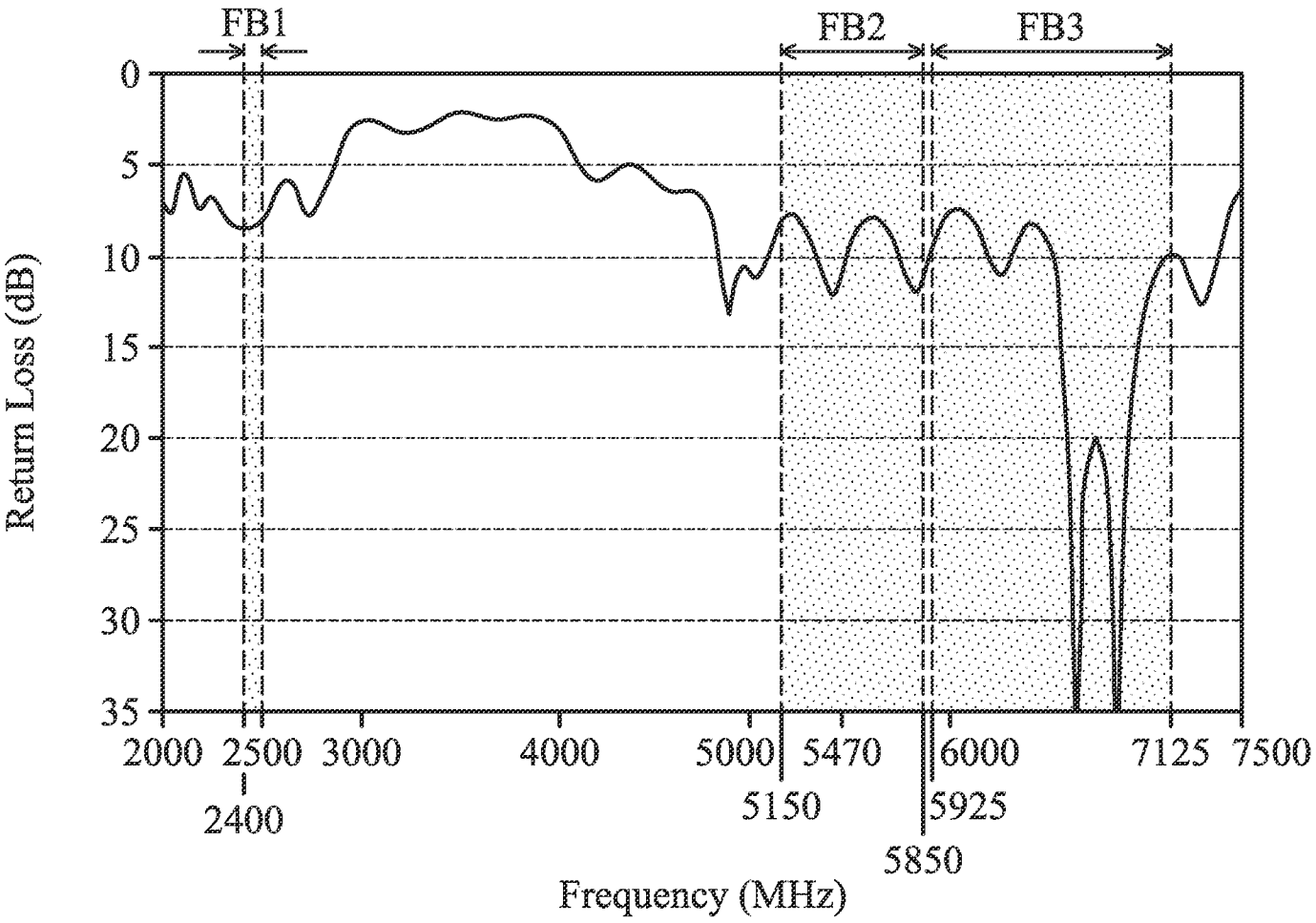
FIG. 2A is a diagram of return loss of an antenna structure when a switch circuit switches to a first feeding point according to an embodiment of the invention.
Figure 2B:
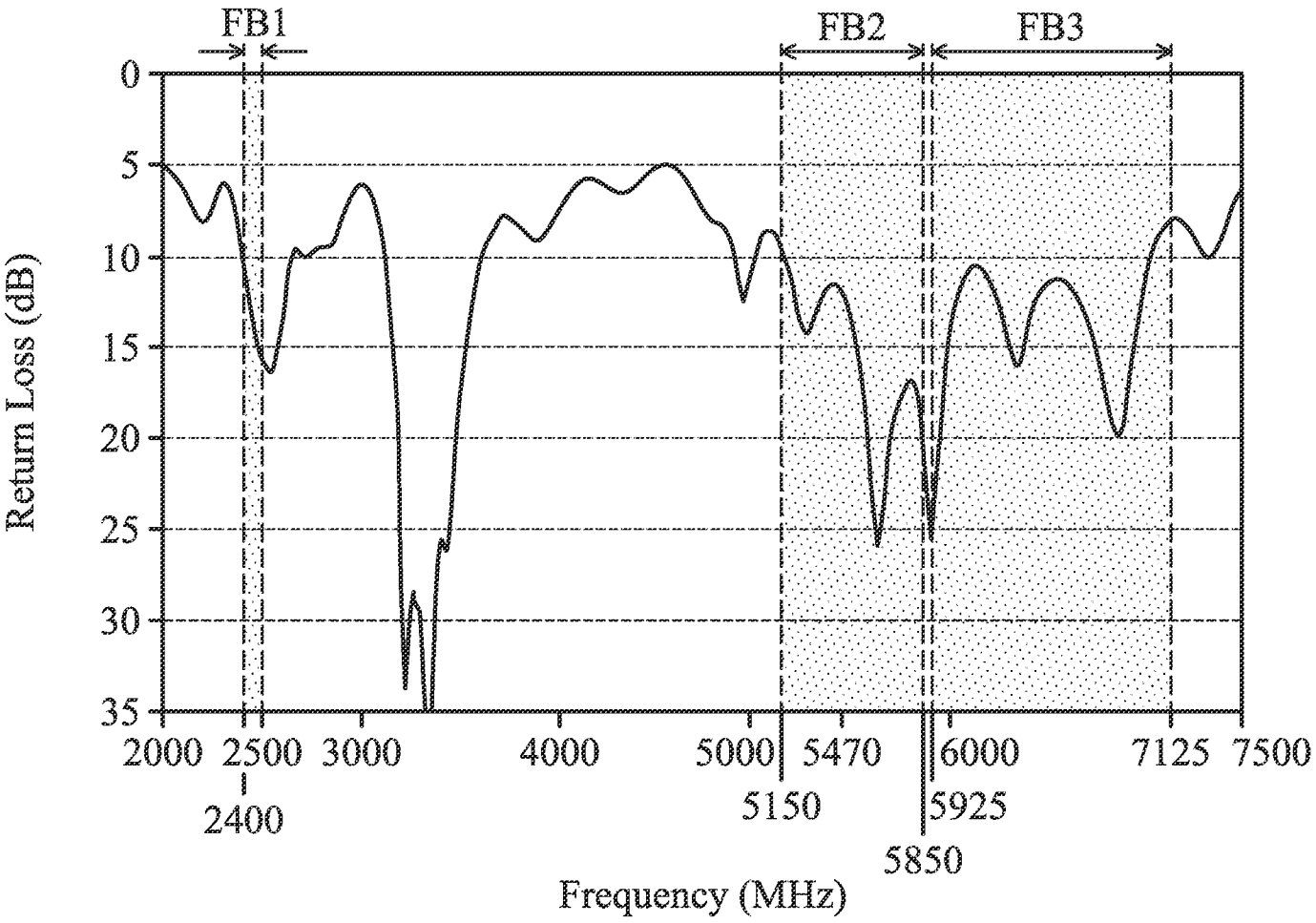
FIG. 2B is a diagram of return loss of an antenna structure when a switch circuit switches to a second feeding point according to an embodiment of the invention.

FIG. 2A is a diagram of return loss of the antenna structure 100 when the switch circuit 270 switches to the first feeding point FP1 according to an embodiment of the invention. FIG. 2B is a diagram of return loss of the antenna structure 100 when the switch circuit 270 switches to the second feeding point FP2 according to an embodiment of the invention. According to the measurement of FIG. 2A and FIG. 2B, the antenna structure 100 can cover a first frequency band FB1, a second frequency band FB2, and a third frequency band FB3. For example, the first frequency band FB1 may be from 2400 MHz to 2500 MHz, the second frequency band FB2 may be from 5150 MHz to 5850 MHz, and the third frequency band FB3 may be from 5925 MHz to 7125 MHz. Accordingly, the antenna structure 100 can support at least the wideband operations of the conventional WLAN (Wireless Local Area Network) 2.4 GHz/5 GHz and the next-generation Wi-Fi 6E. Furthermore, the radiation efficiency of the antenna structure 100 can be higher than 44% within the first frequency band FB1, the second frequency band FB2, and the third frequency band FB3. It can meet the requirements of practical applications of general mobile communication devices.

With respect to the antenna theory, the first radiation element 130, the second radiation element 140, the fifth radiation element 210, and the sixth radiation element 220 can be excited to generate the first frequency band FB1. The third radiation element 150, the fourth radiation element 160, the fifth radiation element 210, and the seventh radiation element 230 can be excited to generate the second frequency band FB2 and the third frequency band FB3. In addition, the first widening portion 225 and the second widening portion 235 can fine-tune the impedance matching of the third frequency band FB3, so as to increase the operation bandwidth the third frequency band FB3.

Figure 3B:
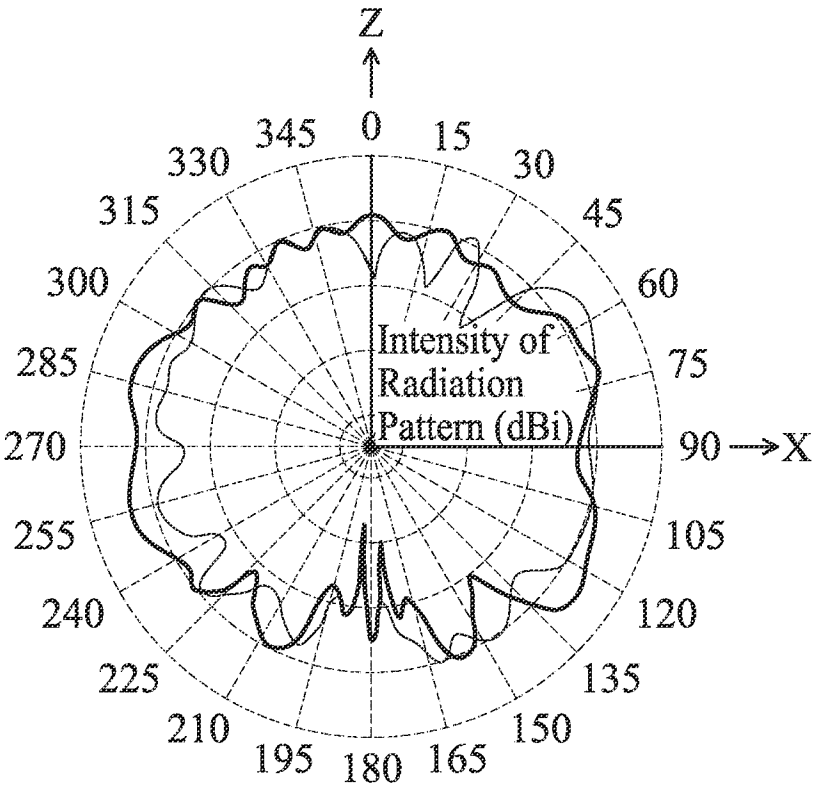
FIG. 3B is a radiation pattern of an antenna structure operating in a second frequency band according to an embodiment of the invention.
Figure 3A:
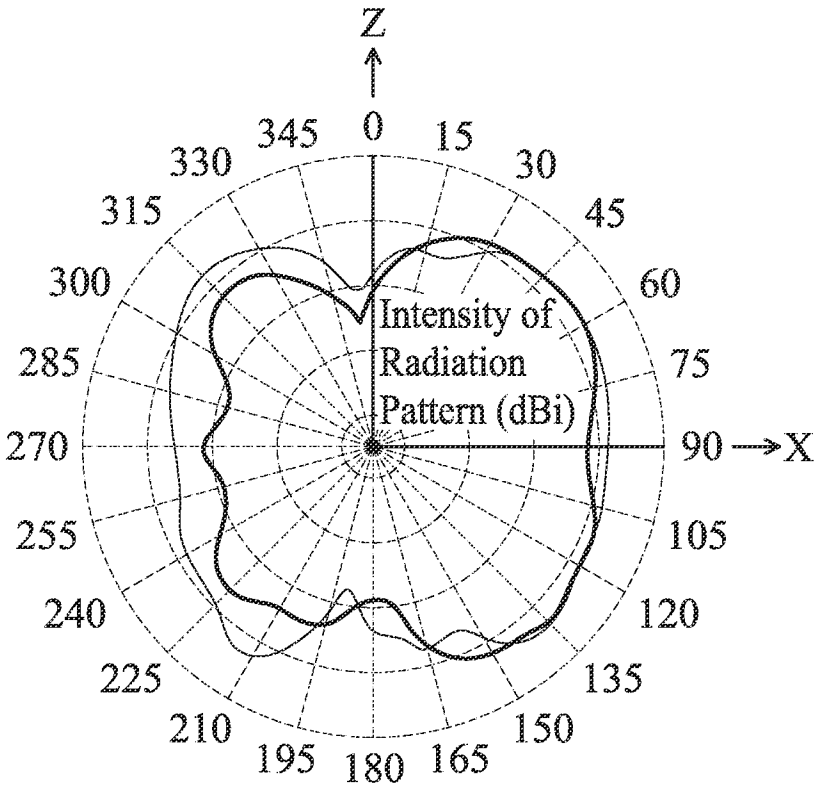
FIG. 3A is a radiation pattern of an antenna structure operating in a first frequency band according to an embodiment of the invention.

FIG. 3A is a radiation pattern of the antenna structure 100 operating in the first frequency band FB1 according to an embodiment of the invention (measured along the XZ-plane). FIG. 3B is a radiation pattern of the antenna structure 100 operating in the second frequency band FB2 according to an embodiment of the invention (measured along the XZ-plane). It should be understood that since the switch circuit 270 is switchable between the first feeding point FP1 and the second feeding point FP2, each of the FIG. 3A and FIG. 3B can provide two different radiation patterns. According to the measurement of FIG. 3A and FIG. 3B, the antenna structure 100 can provide an almost omnidirectional radiation pattern, thereby significantly improving the whole communication quality.

In some embodiments, the element sizes and element parameters of the antenna structure 100 are described as follows. The thickness H1 of the dielectric substrate 120 (i.e., the distance between the first surface E1 and the second surface E2) may be smaller than or equal to 1.6 mm. The length L1 of the first radiation element 130 may be from 0.25 to 0.3 wavelength (0.25λ~0.3λ) of the first frequency band FB1 of the antenna structure 100, such as about 0.3 wavelength (0.3λ). The length L2 of the second radiation element 140 may be from 0.25 to 0.3 wavelength (0.25λ~0.3λ) of the first frequency band FB1 of the antenna structure 100, such as about 0.3 wavelength (0.3λ). The distance D1 between the first end 131 of the first radiation element 130 and the first end 141 of the second radiation element 140 may be shorter than 0.25 wavelength (0.25λ) of the first frequency band FB1 of the antenna structure 100. The length L3 of the third radiation element 150 may be from 0.25 to 0.3 wavelength (0.25λ~0.3λ) of the second frequency band FB2 of the antenna structure 100, such as about 0.3 wavelength (0.3λ). The length L4 of the fourth radiation element 160 may be from 0.25 to 0.3 wavelength (0.25λ~0.3λ) of the second frequency band FB2 of the antenna structure 100, such as about 0.3 wavelength (0.3λ). The total length L5 of the fifth radiation element 210 and the sixth radiation element 220 may be from 0.2 to 0.25 wavelength (0.2λ~0.25λ) of the first frequency band FB1 of the antenna structure 100, such as about 0.2 wavelength (0.2λ). The total length L6 of the fifth radiation element 210 and the seventh radiation element 230 may be substantially equal to wavelength (0.3λ) of the second frequency band FB2 of the antenna structure 100. The above ranges of element sizes and element parameters are calculated and obtained according to many experimental results, and they help to optimize the operation bandwidth and the impedance matching of the antenna structure 100.

Figure 4A:
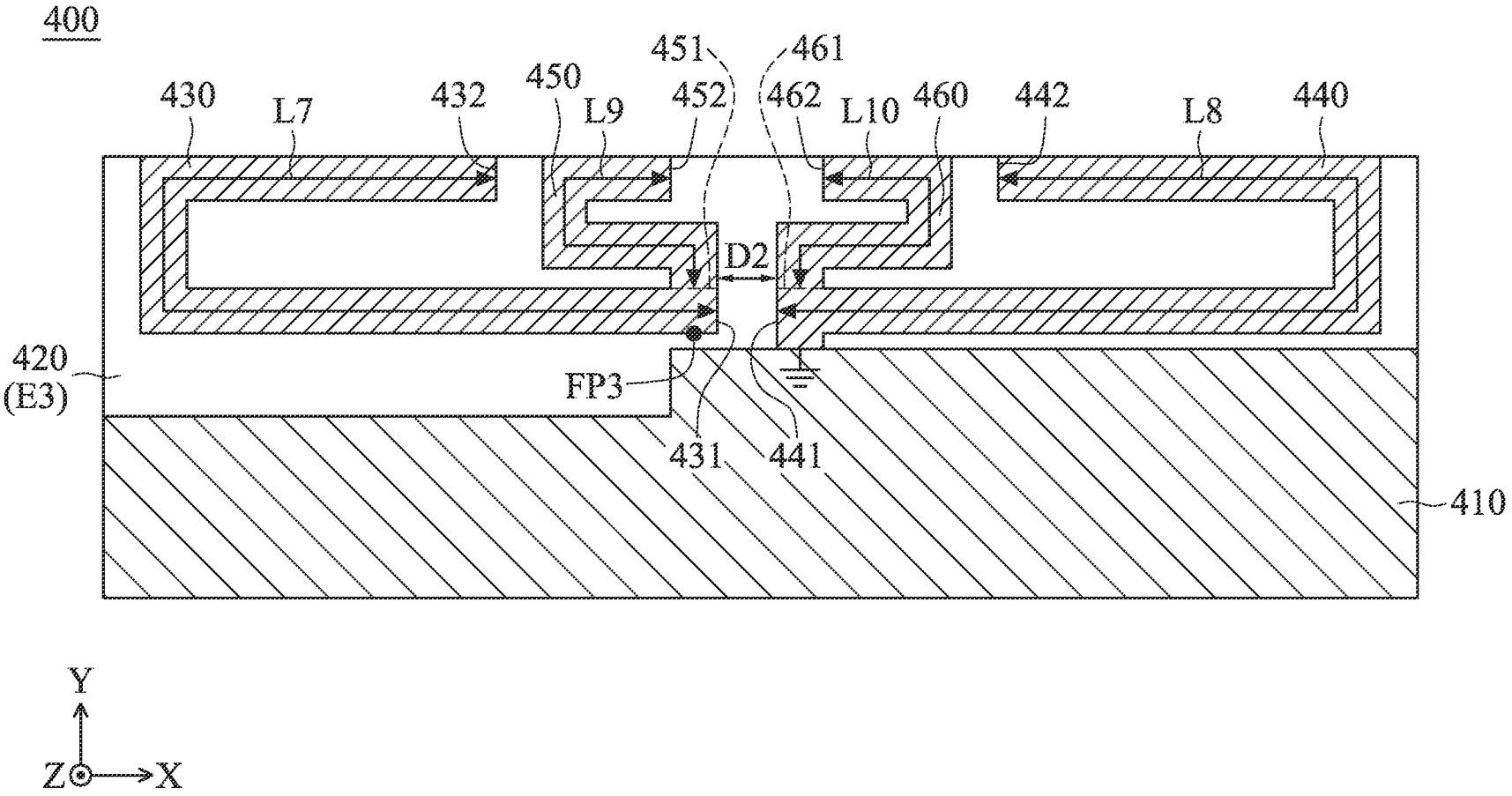
FIG. 4A is a top view of an antenna structure according to an embodiment of the invention.
Figure 4B:
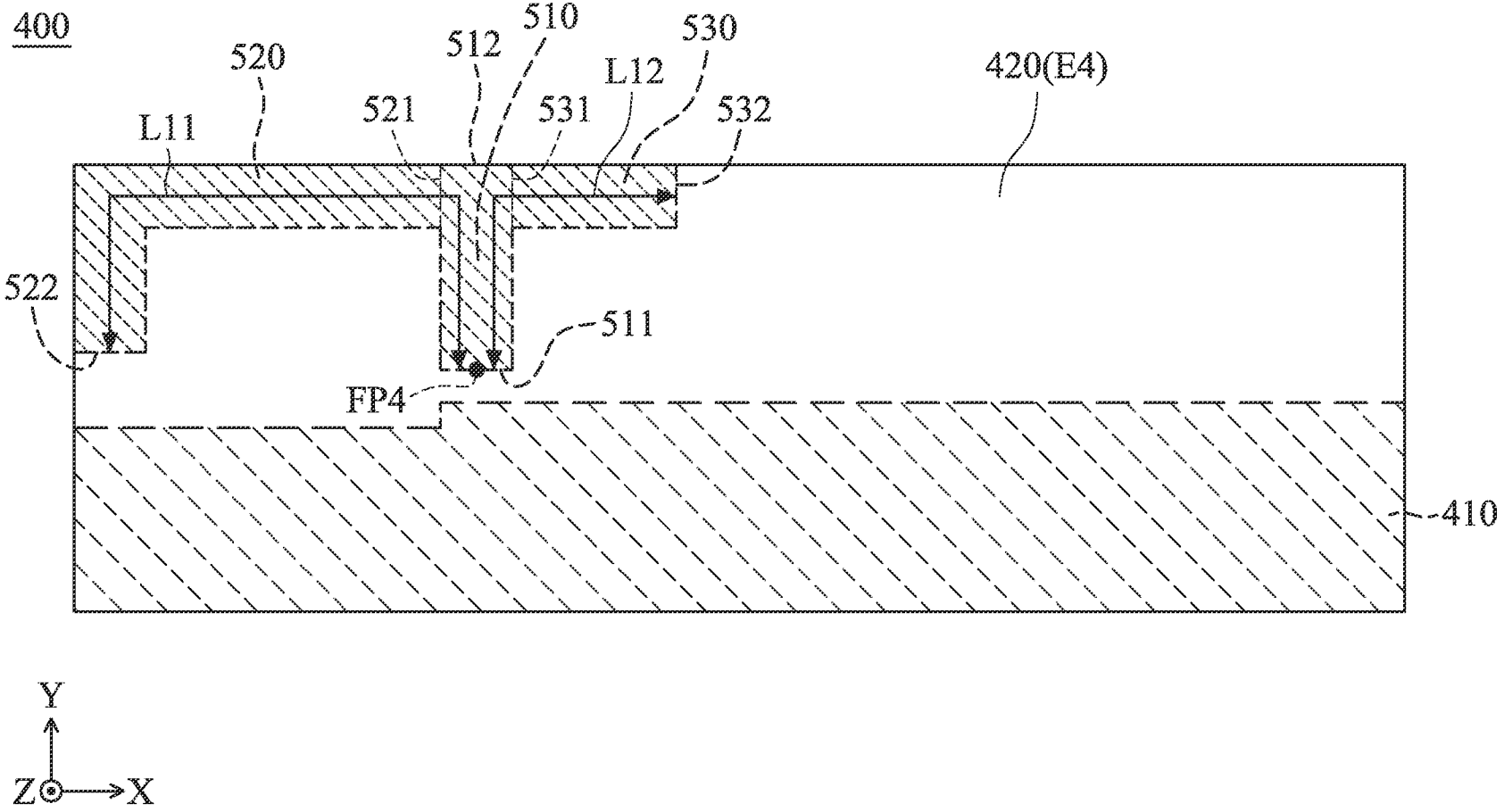
FIG. 4B is a see-through view of an antenna structure according to an embodiment of the invention.

FIG. 4A is a top view of an antenna structure 400 according to an embodiment of the invention. FIG. 4B is a see-through view of the antenna structure 400 according to an embodiment of the invention. In the embodiment of FIG. 4A and FIG. 4B, the antenna structure 400 includes a ground element 410, a dielectric substrate 420, a first radiation element 430, a second radiation element 440, a third radiation element 450, a fourth radiation element 460, a fifth radiation element 510, a sixth radiation element 520, and a seventh radiation element 530. The ground element 410, the first radiation element 430, the second radiation element 440, the third radiation element 450, the fourth radiation element 460, the fifth radiation element 510, the sixth radiation element 520, and the seventh radiation element 530 may all be made of metal materials.

The dielectric substrate 420 has a first surface E3 and a second surface E4 which are opposite to each other. The first radiation element 430, the second radiation element 440, the third radiation element 450, and the fourth radiation element 460 may all be disposed on the first surface E3 of the dielectric substrate 420. The fifth radiation element 510, the sixth radiation element 520, and the seventh radiation element 530 may all be disposed on the second surface E4 of the dielectric substrate 420. In addition, the ground element 410 may extend onto both of the first surface E3 and the second surface E4 of the dielectric substrate 420.

The first radiation element 430 may substantially have a J-shape. Specifically, the first radiation element 430 has a first end 431 and a second end 432. A first feeding point FP3 is positioned at the first end 431 of the first radiation element 430. The second end 432 of the first radiation element 430 is an open end.

The second radiation element 440 may substantially have an inverted J-shape. Specifically, the second radiation element 440 has a first end 441 and a second end 442. The first end 441 of the second radiation element 440 is coupled to the ground element 410. The second end 442 of the second radiation element 440 is an open end. For example, the second end 442 of the second radiation element 440 and the second end 432 of the first radiation element 430 may extend toward each other.

The third radiation element 450 may substantially have a C-shape. Specifically, the third radiation element 450 has a first end 451 and a second end 452. The first end 451 of the third radiation element 450 is coupled to the first end 431 of the first radiation element 430 and the first feeding point FP3. The second end 452 of the third radiation element 450 is an open end.

The fourth radiation element 460 may substantially have an inverted C-shape. Specifically, the fourth radiation element 460 has a first end 461 and a second end 462. The first end 461 of the fourth radiation element 460 is coupled to the first end 441 of the second radiation element 440 and the ground element 410. The second end 462 of the fourth radiation element 460 is an open end. For example, the second end 462 of the fourth radiation element 460 and the second end 452 of the third radiation element 450 may extend toward each other.

The fifth radiation element 510 may substantially have a straight-line shape. Specifically, the fifth radiation element 510 has a first end 511 and a second end 512. A second feeding point FP4 is positioned at the first end 511 of the fifth radiation element 510.

The sixth radiation element 520 may substantially have an L-shape. Specifically, the sixth radiation element 520 has a first end 521 and a second end 522. The first end 521 of the sixth radiation element 520 is coupled to the second end 512 of the fifth radiation element 510. The second end 522 of the sixth radiation element 520 is an open end, which may extend toward the ground element 410. Furthermore, the first radiation element 430 has a vertical projection on the second surface E4 of the dielectric substrate 420, and the vertical projection of the first radiation element 430 at least partially overlaps the fifth radiation element 510 and the sixth radiation element 520.

The seventh radiation element 530 may substantially have a straight-line shape, which may be substantially perpendicular to the fifth radiation element 510. Specifically, the seventh radiation element 530 has a first end 531 and a second end 532. The first end 531 of the seventh radiation element 530 is coupled to the second end 512 of the fifth radiation element 510. The second end 532 of the seventh radiation element 530 is an open end, which may extend away from the fifth radiation element 510. Furthermore, the third radiation element 450 has a vertical projection on the second surface E4 of the dielectric substrate 420, and the vertical projection of the third radiation element 450 at least partially overlaps the seventh radiation element 530.

Figure 4C:
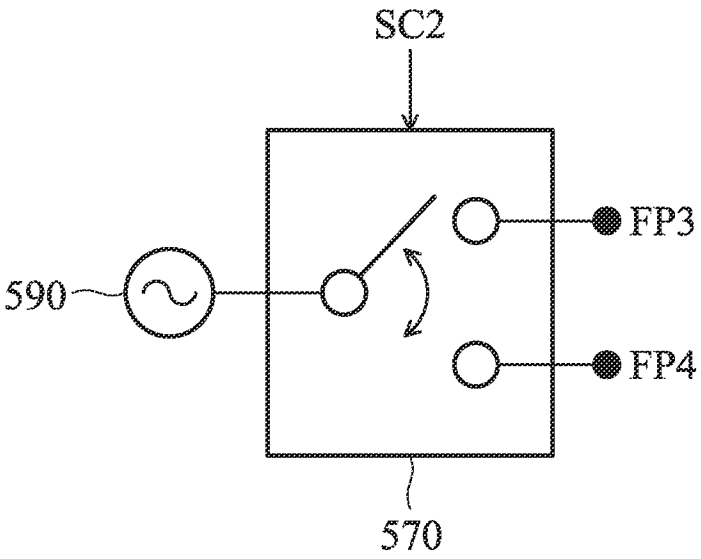
FIG. 4C is a diagram of a switch circuit and a signal source according to an embodiment of the invention.

FIG. 4C is a diagram of a switch circuit 570 and a signal source 590 according to an embodiment of the invention. In the embodiment of FIG. 4C, the antenna structure 400 further includes the switch circuit 570 and the signal source 590. The switch circuit 570 can couple the signal source 590 to either the first feeding point FP3 or the second feeding point FP4 according to a control signal SC2.

Figure 5A:
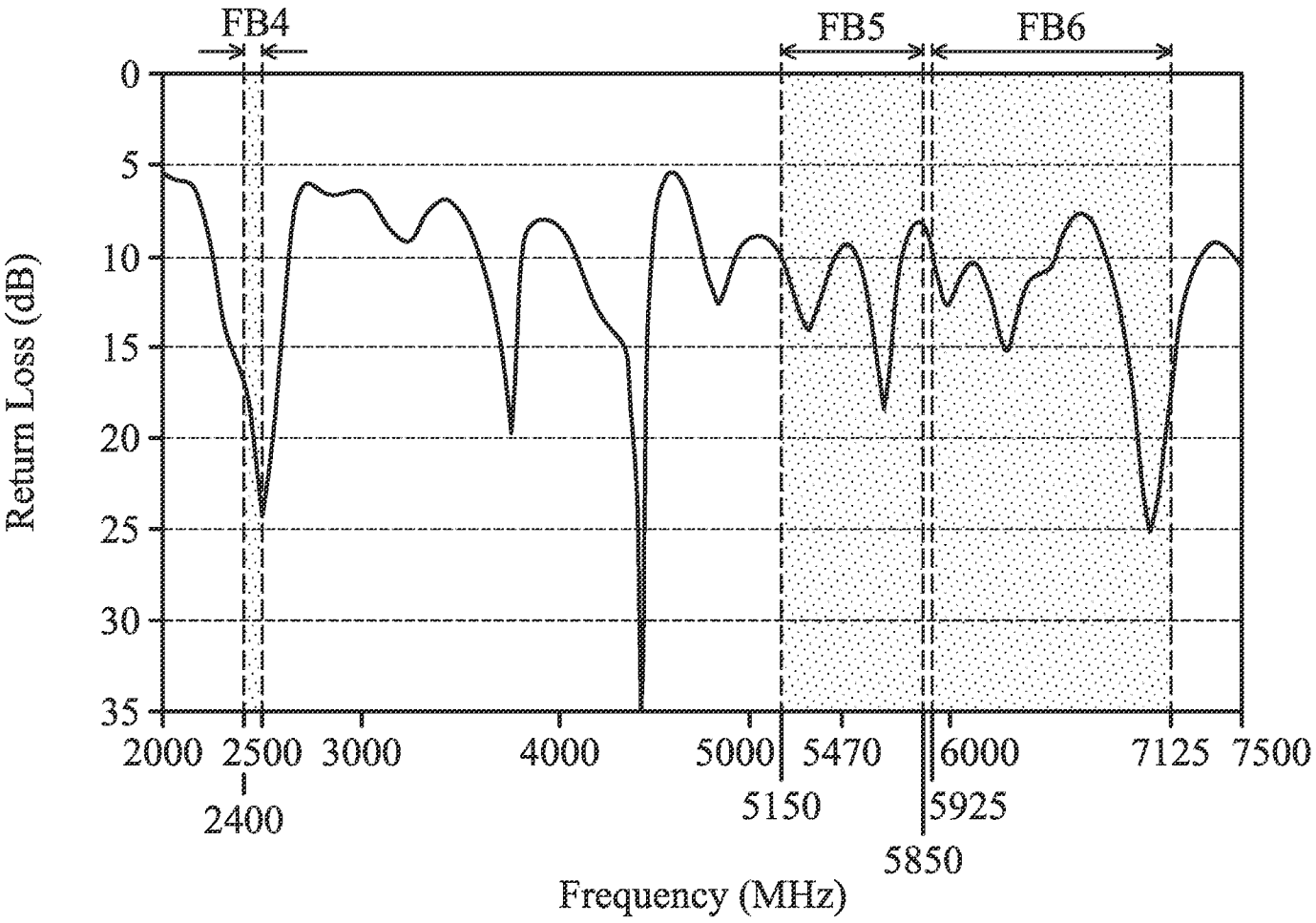
FIG. 5A is a diagram of return loss of an antenna structure when a switch circuit switches to a first feeding point according to an embodiment of the invention.
Figure 5B:
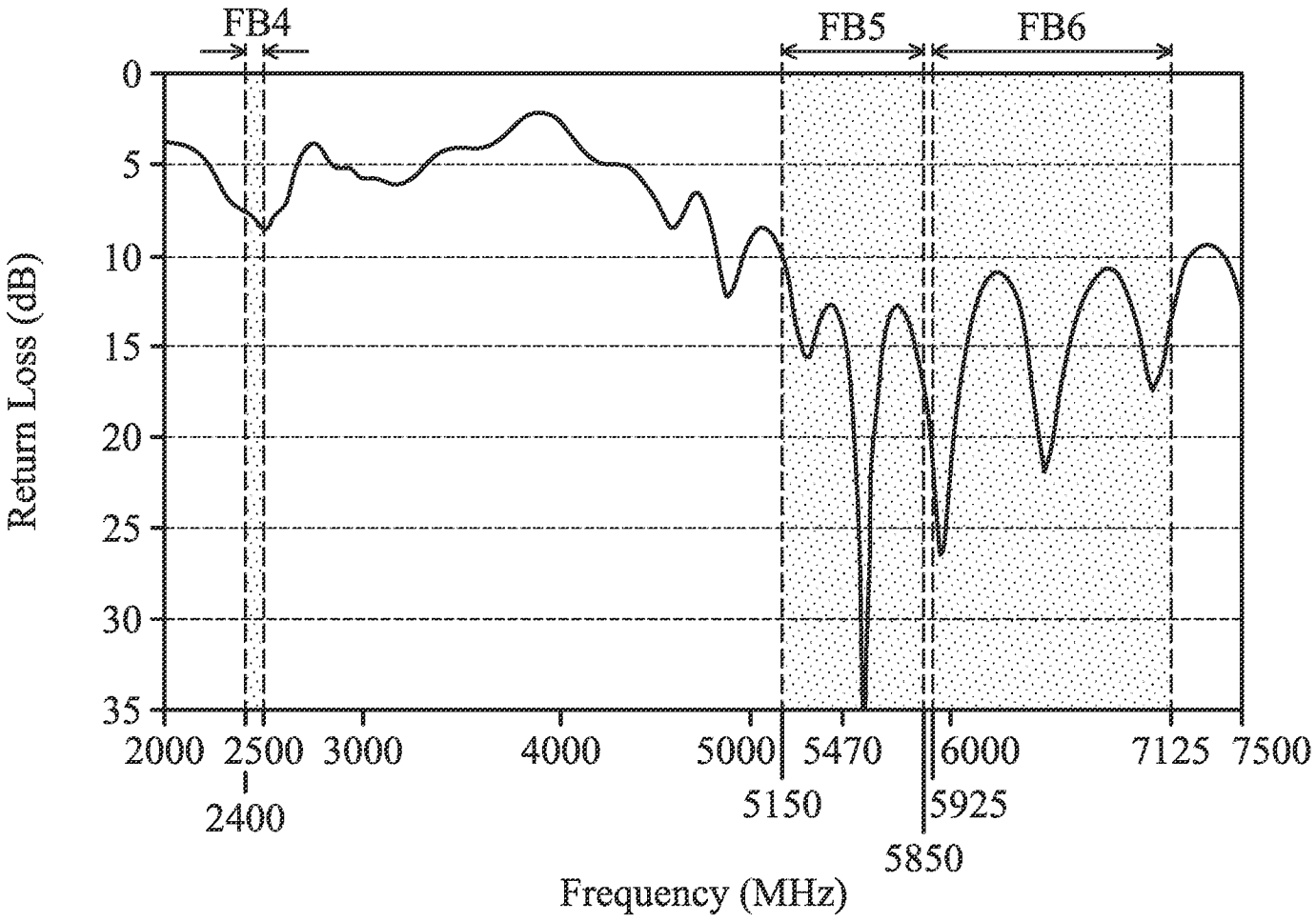
FIG. 5B is a diagram of return loss of an antenna structure when a switch circuit switches to a second feeding point according to an embodiment of the invention.

FIG. 5A is a diagram of return loss of the antenna structure 400 when the switch circuit 570 switches to the first feeding point FP3 according to an embodiment of the invention. FIG. 5B is a diagram of return loss of the antenna structure 400 when the switch circuit 570 switches to the second feeding point FP4 according to an embodiment of the invention. According to the measurement of FIG. 5A and FIG. 5B, the antenna structure 400 can cover a first frequency band FB4, a second frequency band FB5, and a third frequency band FB6. For example, the first frequency band FB4 may be from 2400 MHz to 2500 MHz, the second frequency band FB5 may be from 5150 MHz to 5850 MHz, and the third frequency band FB6 may be from 5925 MHz to 7125 MHz. Accordingly, the antenna structure 400 can support at least the wideband operations of the conventional WLAN 2.4 GHz/5 GHz and the next-generation Wi-Fi 6E. Furthermore, the radiation efficiency of the antenna structure 400 can be higher than 34% within the first frequency band FB4, the second frequency band FB5, and the third frequency band FB6. It can meet the requirements of practical applications of general mobile communication devices.

With respect to the antenna theory, the first radiation element 430, the second radiation element 440, the fifth radiation element 510, and the sixth radiation element 520 can be excited to generate the first frequency band FB4. The third radiation element 450, the fourth radiation element 460, the fifth radiation element 510, and the seventh radiation element 530 can be excited to generate the second frequency band FB5 and the third frequency band FB6.

In some embodiments, the element sizes and element parameters of the antenna structure 400 are described as follows. The length L7 of the first radiation element 430 may be from 0.25 to 0.3 wavelength (0.25λ~0.3λ) of the first frequency band FB4 of the antenna structure 400, such as about 0.25 wavelength (0.25λ). The length L8 of the second radiation element 440 may be from 0.25 to 0.3 wavelength (0.25λ~0.3λ) of the first frequency band FB4 of the antenna structure 400, such as about 0.25 wavelength (0.25λ). The distance D2 between the first end 431 of the first radiation element 430 and the first end 441 of the second radiation element 440 may be shorter than 0.25 wavelength (0.25λ) of the first frequency band FB4 of the antenna structure 400. The length L9 of the third radiation element 450 may be from 0.25 to 0.3 wavelength (0.25λ~0.3λ) of the second frequency band FB5 of the antenna structure 400, such as about 0.25 wavelength (0.25λ). The length L10 of the fourth radiation element 460 may be from 0.25 to 0.3 wavelength (0.25λ~0.3λ) of the second frequency band FB5 of the antenna structure 400, such as about 0.25 wavelength (0.25λ). The total length L11 of the fifth radiation element 510 and the sixth radiation element 520 may be substantially equal to 0.2 wavelength (0.2λ) of the first frequency band FB4 of the antenna structure 400. The total length L12 of the fifth radiation element 510 and the seventh radiation element 530 may be substantially equal to wavelength (0.2λ) of the second frequency band FB5 of the antenna structure 400. The above ranges of element sizes and element parameters are calculated and obtained according to many experimental results, and they help to optimize the operation bandwidth and the impedance matching of the antenna structure 400. Other features of the antenna structure 400 of FIG. 4A, FIG. 4B and FIG. 4C are similar to those of the antenna structure 100 of FIG. 1A, FIG. 1B, FIG. 1C and FIG. 1D. Therefore, the two embodiments can achieve similar levels of the performance.

Figure 6A:
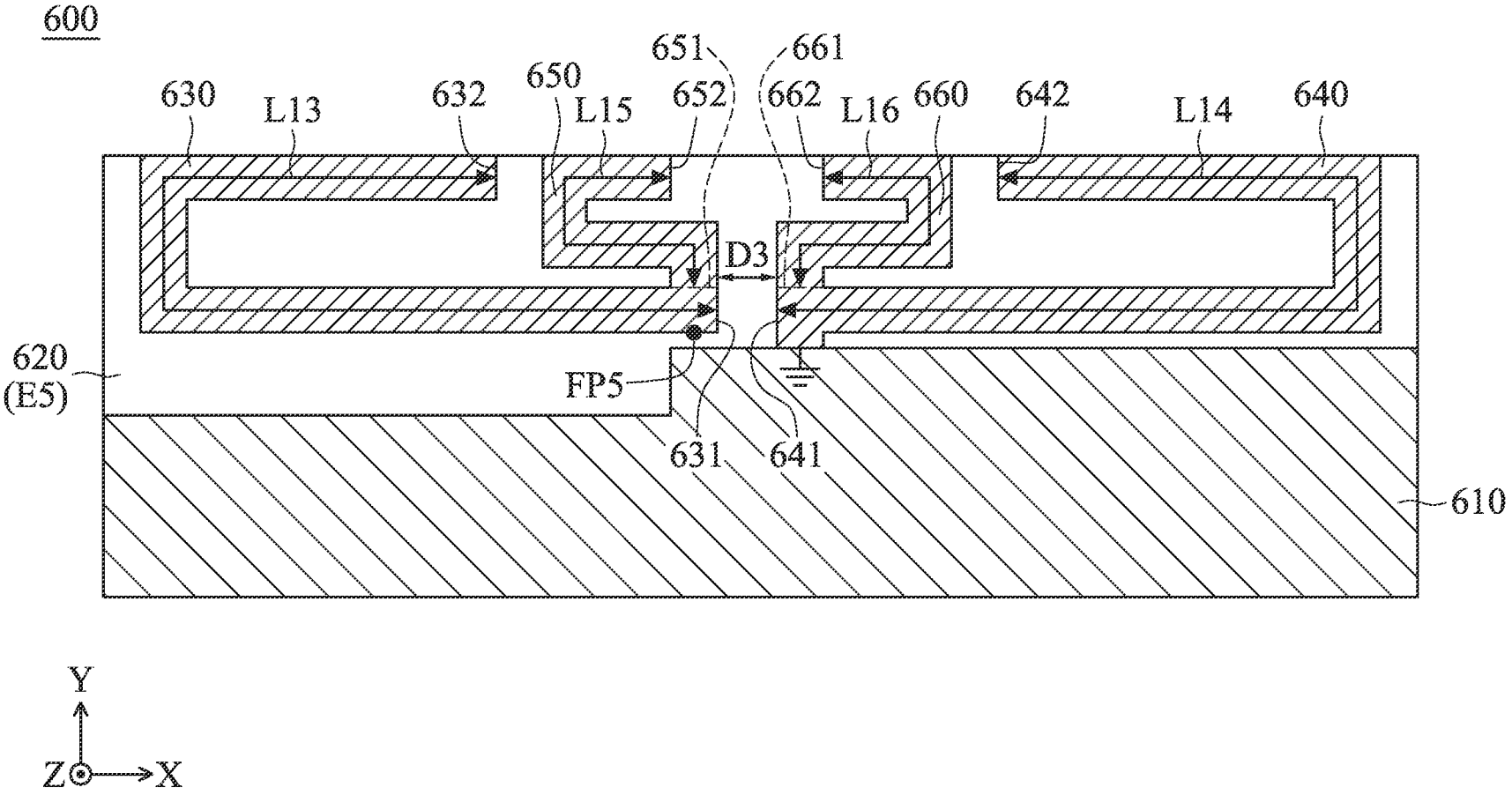
FIG. 6A is a top view of an antenna structure according to an embodiment of the invention.
Figure 6B:
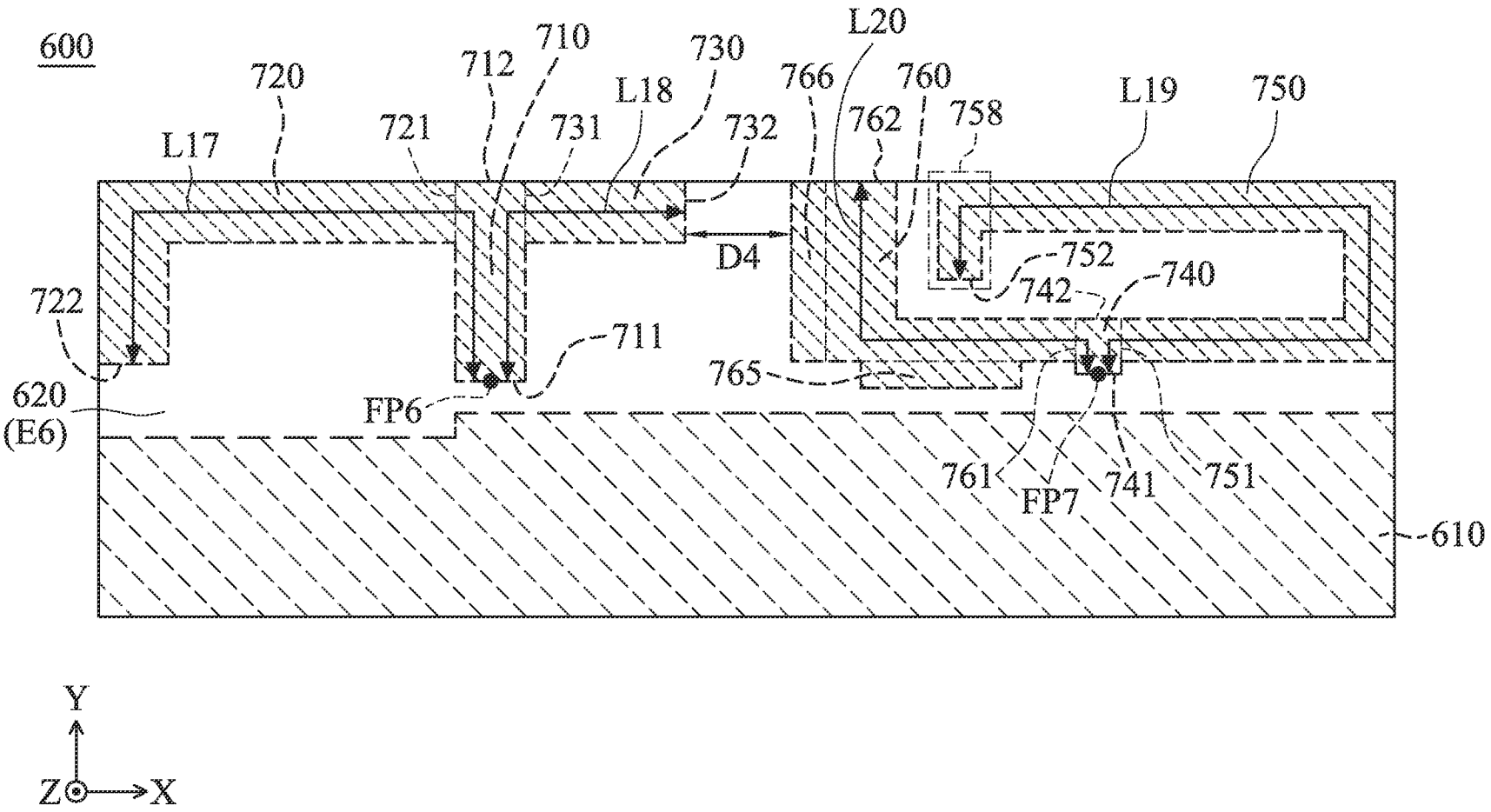
FIG. 6B is a see-through view of an antenna structure according to an embodiment of the invention.

FIG. 6A is a top view of an antenna structure 600 according to an embodiment of the invention. FIG. 6B is a see-through view of the antenna structure 600 according to an embodiment of the invention. In the embodiment of FIG. 6A and FIG. 6B, the antenna structure 600 includes a ground element 610, a dielectric substrate 620, a first radiation element 630, a second radiation element 640, a third radiation element 650, a fourth radiation element 660, a fifth radiation element 710, a sixth radiation element 720, a seventh radiation element 730, an eighth radiation element 740, a ninth radiation element 750, and a tenth radiation element 760. The ground element 610, the first radiation element 630, the second radiation element 640, the third radiation element 650, the fourth radiation element 660, the fifth radiation element 710, the sixth radiation element 720, the seventh radiation element 730, the eighth radiation element 740, the ninth radiation element 750, and the tenth radiation element 760 may all be made of metal materials.

The dielectric substrate 620 has a first surface E5 and a second surface E6 which are opposite to each other. The first radiation element 630, the second radiation element 640, the third radiation element 650, and the fourth radiation element 660 may all be disposed on the first surface E5 of the dielectric substrate 620. The fifth radiation element 710, the sixth radiation element 720, the seventh radiation element 730, the eighth radiation element 740, the ninth radiation element 750, and the tenth radiation element 760 may all be disposed on the second surface E6 of the dielectric substrate 620. In addition, the ground element 610 may extend onto both of the first surface E5 and the second surface E6 of the dielectric substrate 620.

The first radiation element 630 may substantially have a J-shape. Specifically, the first radiation element 630 has a first end 631 and a second end 632. A first feeding point FP5 is positioned at the first end 631 of the first radiation element 630. The second end 632 of the first radiation element 630 is an open end.

The second radiation element 640 may substantially have an inverted J-shape. Specifically, the second radiation element 640 has a first end 641 and a second end 642. The first end 641 of the second radiation element 640 is coupled to the ground element 610. The second end 642 of the second radiation element 640 is an open end. For example, the second end 642 of the second radiation element 640 and the second end 632 of the first radiation element 630 may extend toward each other.

The third radiation element 650 may substantially have a C-shape. Specifically, the third radiation element 650 has a first end 651 and a second end 652. The first end 651 of the third radiation element 650 is coupled to the first end 631 of the first radiation element 630 and the first feeding point FP5. The second end 652 of the third radiation element 650 is an open end.

The fourth radiation element 660 may substantially have an inverted C-shape. Specifically, the fourth radiation element 660 has a first end 661 and a second end 662. The first end 661 of the fourth radiation element 660 is coupled to the first end 641 of the second radiation element 640 and the ground element 610. The second end 662 of the fourth radiation element 660 is an open end. For example, the second end 662 of the fourth radiation element 660 and the second end 652 of the third radiation element 650 may extend toward each other.

The fifth radiation element 710 may substantially have a straight-line shape. Specifically, the fifth radiation element 710 has a first end 711 and a second end 712. A second feeding point FP6 is positioned at the first end 711 of the fifth radiation element 710.

The sixth radiation element 720 may substantially have an L-shape. Specifically, the sixth radiation element 720 has a first end 721 and a second end 722. The first end 721 of the sixth radiation element 720 is coupled to the second end 712 of the fifth radiation element 710. The second end 722 of the sixth radiation element 720 is an open end, which may extend toward the ground element 610. Furthermore, the first radiation element 630 has a vertical projection on the second surface E6 of the dielectric substrate 620, and the vertical projection of the first radiation element 630 at least partially overlaps the fifth radiation element 710 and the sixth radiation element 720.

The seventh radiation element 730 may substantially have a straight-line shape, which may be substantially perpendicular to the fifth radiation element 710. Specifically, the seventh radiation element 730 has a first end 731 and a second end 732. The first end 731 of the seventh radiation element 730 is coupled to the second end 712 of the fifth radiation element 710. The second end 732 of the seventh radiation element 730 is an open end, which may extend away from the fifth radiation element 710. Furthermore, the third radiation element 650 has a vertical projection on the second surface E6 of the dielectric substrate 620, and the vertical projection of the third radiation element 650 at least partially overlaps the seventh radiation element 730.

The eighth radiation element 740 may substantially have a straight-line shape. Specifically, the eighth radiation element 740 has a first end 741 and a second end 742. A third feeding point FP7 is positioned at the first end 741 of the eighth radiation element 740.

The ninth radiation element 750 may substantially have a U-shape. Specifically, the ninth radiation element 750 has a first end 751 and a second end 752. The first end 751 of the ninth radiation element 750 is coupled to the second end 742 of the eighth radiation element 740. The second end 752 of the ninth radiation element 750 is an open end, which may extend toward the ground element 610. Furthermore, the second radiation element 640 has a vertical projection on the second surface E6 of the dielectric substrate 620, and the vertical projection of the second radiation element 640 at least partially overlaps the eighth radiation element 740 and the ninth radiation element 750. In some embodiments, the ninth radiation element 750 further includes a terminal bending portion 758, which is adjacent to the second end 752 of the ninth radiation element 750.

The tenth radiation element 760 may substantially have an L-shape. Specifically, the tenth radiation element 760 has a first end 761 and a second end 762. The first end 761 of the tenth radiation element 760 is coupled to the second end 742 of the eighth radiation element 740. The second end 762 of the tenth radiation element 760 is an open end, which may extend away from the ground element 610. In some embodiments, the tenth radiation element 760 further includes a first widening portion 765 and a second widening portion 766, each of which may substantially have a long, thin rectangular shape. Thus, the tenth radiation element 760 may be a variable-width structure. For example, the first widening portion 765 may be adjacent to the third feeding point FP7, and the second widening portion 766 may be substantially perpendicular to the first widening portion 765. Furthermore, the fourth radiation element 660 has a vertical projection on the second surface E6 of the dielectric substrate 620, and the vertical projection of the fourth radiation element 660 at least partially overlaps the tenth radiation element 760.

Figure 6C:
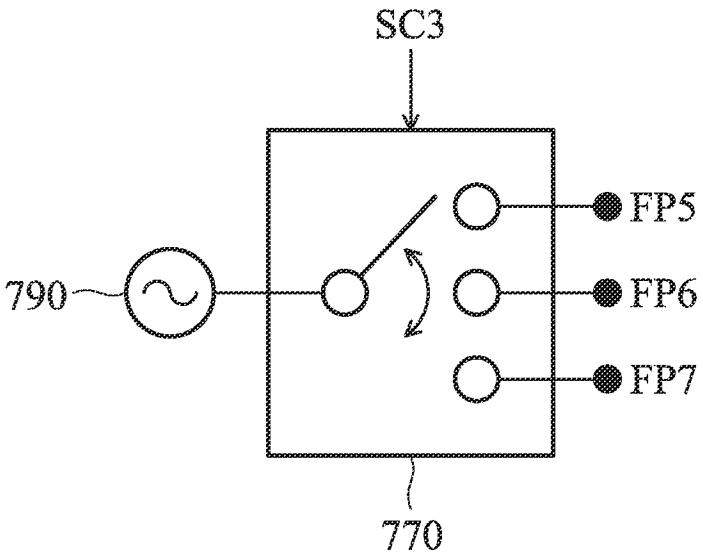
FIG. 6C is a diagram of a switch circuit and a signal source according to an embodiment of the invention.

FIG. 6C is a diagram of a switch circuit 770 and a signal source 790 according to an embodiment of the invention. In the embodiment of FIG. 6C, the antenna structure 600 further includes the switch circuit 770 and the signal source 790. The switch circuit 770 can couple the signal source 790 to either the first feeding point FP5, the second feeding point FP6, or the third feeding point FP7 according to a control signal SC3.

Figure 7A:
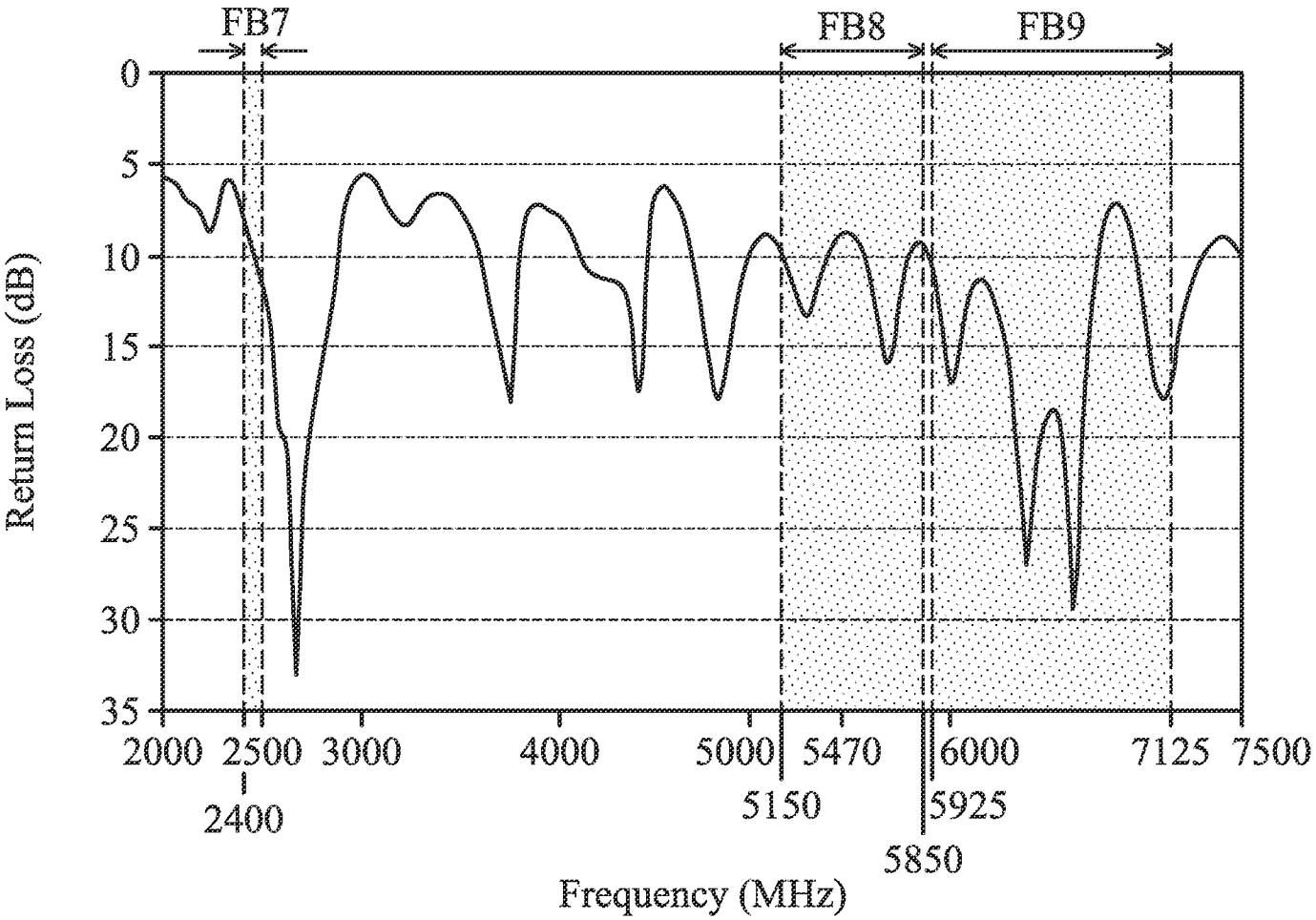
FIG. 7A is a diagram of return loss of an antenna structure when a switch circuit switches to a first feeding point according to an embodiment of the invention.
Figure 7B:
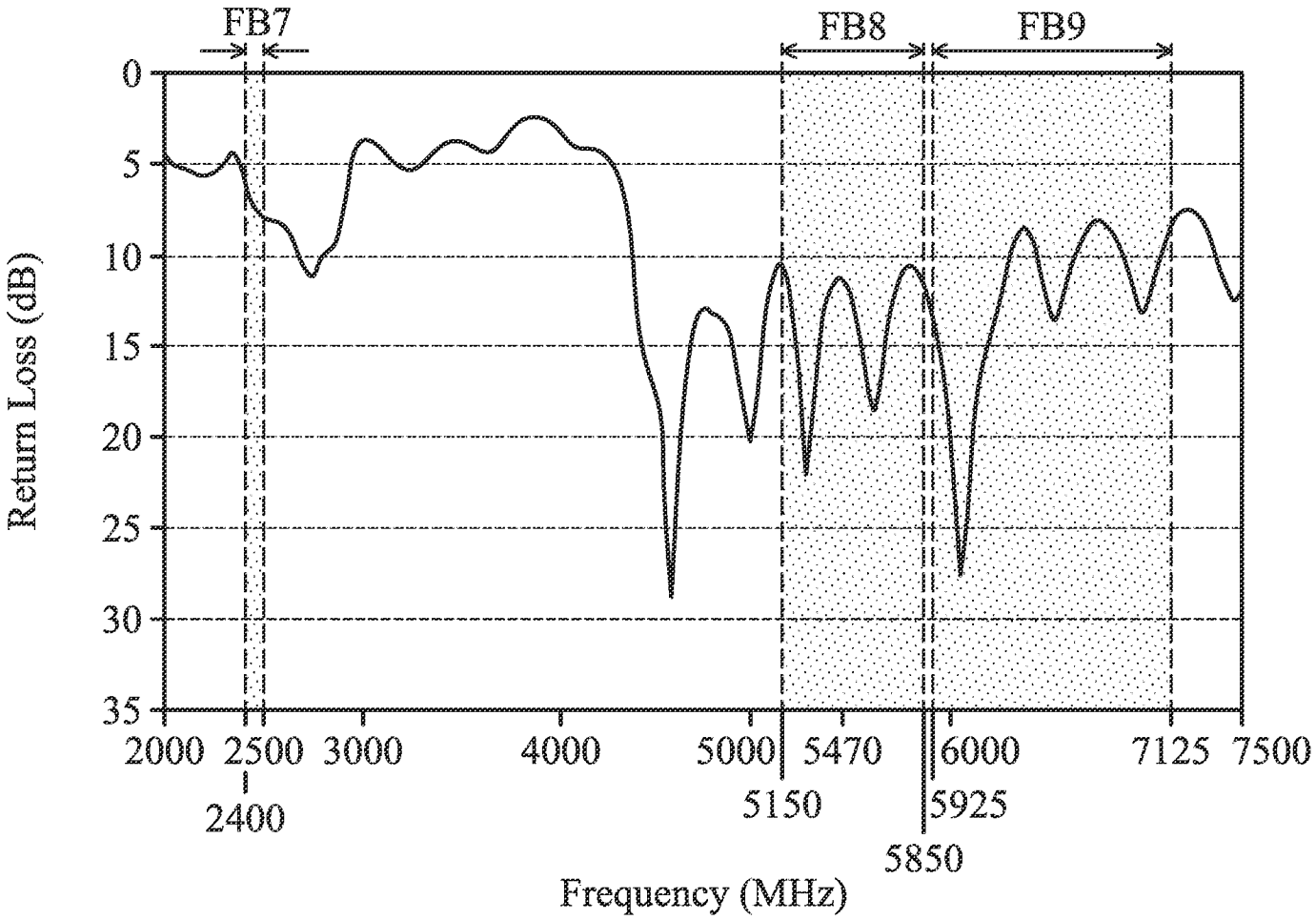
FIG. 7B is a diagram of return loss of an antenna structure when a switch circuit switches to a second feeding point according to an embodiment of the invention.
Figure 7C:
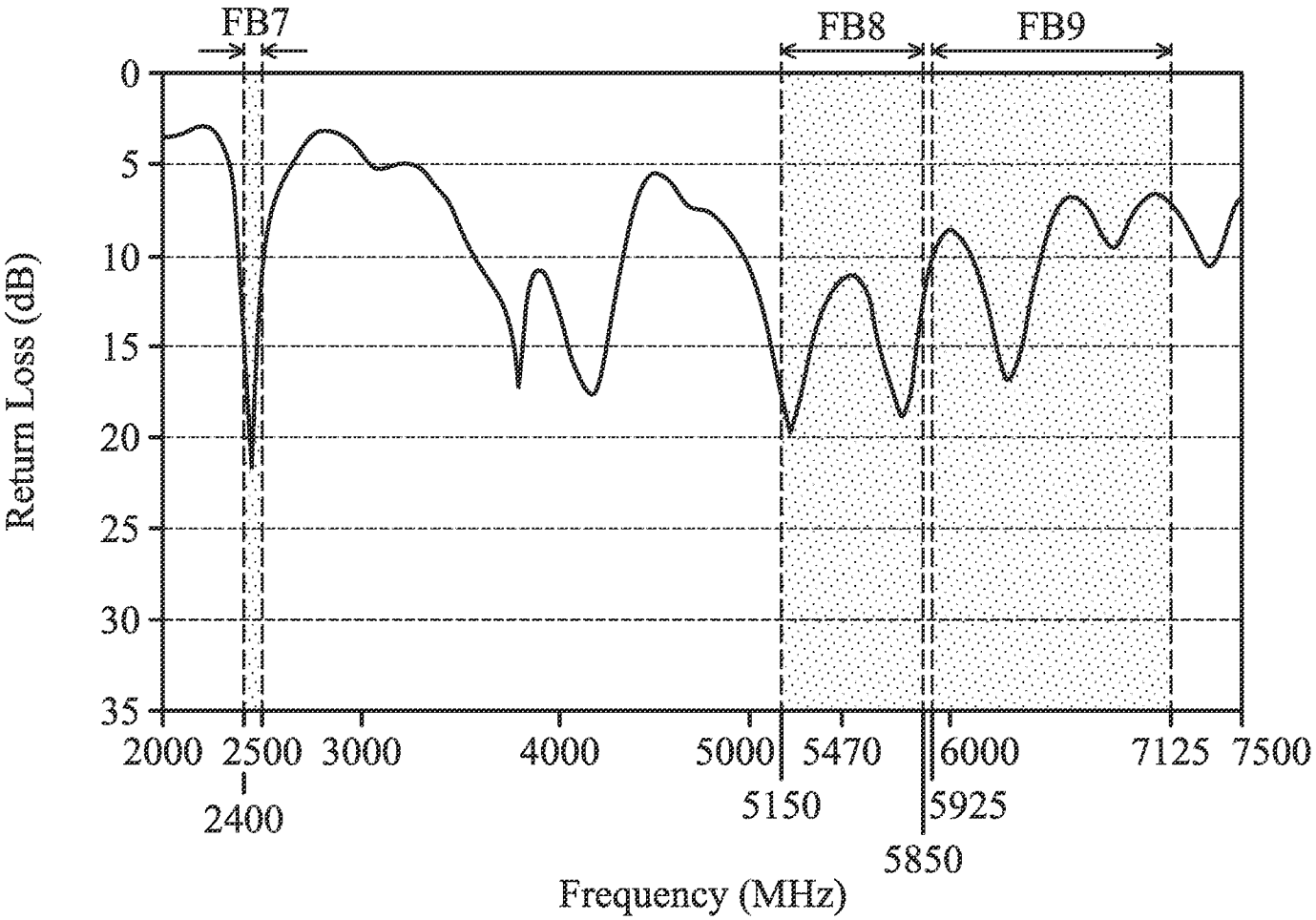
FIG. 7C is a diagram of return loss of an antenna structure when a switch circuit switches to a third feeding point according to an embodiment of the invention.

FIG. 7A is a diagram of return loss of the antenna structure 600 when the switch circuit 770 switches to the first feeding point FP5 according to an embodiment of the invention. FIG. 7B is a diagram of return loss of the antenna structure 600 when the switch circuit 770 switches to the second feeding point FP6 according to an embodiment of the invention. FIG. 7C is a diagram of return loss of the antenna structure 600 when the switch circuit 770 switches to the third feeding point FP7 according to an embodiment of the invention. According to the measurement of FIG. 7A, FIG. 7B and FIG. 7C, the antenna structure 600 can cover a first frequency band FB7, a second frequency band FB8, and a third frequency band FB9. For example, the first frequency band FB7 may be from 2400 MHz to 2500 MHz, the second frequency band FB8 may be from 5150 MHz to 5850 MHz, and the third frequency band FB9 may be from 5925 MHz to 7125 MHz. Accordingly, the antenna structure 600 can support at least the wideband operations of the conventional WLAN 2.4 GHz/5 GHz and the next-generation Wi-Fi 6E. Furthermore, the radiation efficiency of the antenna structure 600 can be higher than 35% within the first frequency band FB7, the second frequency band FB8, and the third frequency band FB9. It can meet the requirements of practical applications of general mobile communication devices.

With respect to the antenna theory, the first radiation element 630, the second radiation element 640, the fifth radiation element 710, the sixth radiation element 720, the eighth radiation element 740, and the ninth radiation element 750 can be excited to generate the first frequency band FB7. The third radiation element 650, the fourth radiation element 660, the fifth radiation element 710, the seventh radiation element 730, the eighth radiation element 740, and the tenth radiation element 760 can be excited to generate the second frequency band FB8 and the third frequency band FB9. In addition, the first widening portion 765 and the second widening portion 766 can fine-tune the impedance matching of the third frequency band FB9, so as to increase the operation bandwidth the third frequency band FB9.

In some embodiments, the element sizes and element parameters of the antenna structure 600 are described as follows. The length L13 of the first radiation element 630 may be from 0.25 to 0.3 wavelength (0.25λ~0.3λ) of the first frequency band FB7 of the antenna structure 600, such as about 0.25 wavelength (0.25λ). The length L14 of the second radiation element 640 may be from 0.25 to 0.3 wavelength (0.25λ~0.3λ) of the first frequency band FB7 of the antenna structure 600, such as about 0.25 wavelength (0.25λ). The distance D3 between the first end 631 of the first radiation element 630 and the first end 641 of the second radiation element 640 may be shorter than 0.25 wavelength (0.25λ) of the first frequency band FB7 of the antenna structure 600. The length L15 of the third radiation element 650 may be from 0.25 to 0.3 wavelength (0.25λ~0.3λ) of the second frequency band FB8 of the antenna structure 600, such as about 0.25 wavelength (0.25λ). The length L16 of the fourth radiation element 660 may be from 0.25 to 0.3 wavelength (0.25λ~0.3λ) of the second frequency band FB8 of the antenna structure 600, such as about 0.25 wavelength (0.25λ). The total length L17 of the fifth radiation element 710 and the sixth radiation element 720 may be substantially equal to 0.2 wavelength (0.2λ) of the first frequency band FB7 of the antenna structure 600. The total length L18 of the fifth radiation element 710 and the seventh radiation element 730 may be substantially equal to wavelength (0.2λ) of the second frequency band FB8 of the antenna structure 600. The total length L19 of the eighth radiation element 740 and the ninth radiation element 750 may be from 0.2 to 0.25 wavelength (0.2λ~0.25λ) of the first frequency band FB7 of the antenna structure 600, such as about 0.25 wavelength (0.25λ). The total length L20 of the eighth radiation element 740 and the tenth radiation element 760 may be substantially equal to 0.3 wavelength (0.3λ) of the second frequency band FB8 of the antenna structure 600. The distance D4 between the second widening portion 766 of the seventh radiation element 730 and the second end 762 of the tenth radiation element 760 may be longer than or equal to 2 mm. The above ranges of element sizes and element parameters are calculated and obtained according to many experimental results, and they help to optimize the operation bandwidth and the impedance matching of the antenna structure 600. Other features of the antenna structure 600 of FIG. 6A, FIG. 6B and FIG. 6C are similar to those of the antenna structure 100 of FIG. 1A, FIG. 1B, FIG. 1C and FIG. 1D. Therefore, the two embodiments can achieve similar levels of the performance.

The invention proposes a novel antenna structure. In comparison to the conventional technology, the invention has at least the advantages of small size, wide bandwidth, low manufacturing cost, and almost omnidirectional radiation, and therefore it is suitable for application in a variety of communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground element;

a dielectric substrate, having a first surface and a second surface opposite to each other;

a first radiation element, having a first feeding point;

a second radiation element, coupled to the ground element;

a third radiation element, coupled to the first feeding point;

a fourth radiation element, coupled to the ground element, wherein the first radiation element, the second radiation element, the third radiation element, and the fourth radiation element are disposed on the first surface of the dielectric substrate;

a fifth radiation element, having a second feeding point;

a sixth radiation element, coupled to the fifth radiation element; and a seventh radiation element, coupled to the fifth radiation element, wherein the fifth radiation element, the sixth radiation element, and the seventh radiation element are disposed on the second surface of the dielectric substrate;

wherein the fifth radiation element is positioned between the sixth radiation element and the seventh radiation element.

2. The antenna structure as claimed in claim 1, further comprising:

a signal source; and a switch circuit, coupling the signal source to the first feeding point or the second feeding point according to a control signal.

3. The antenna structure as claimed in claim 1, wherein the third radiation element and the fourth radiation element are positioned between the first radiation element and the second radiation element.

4. The antenna structure as claimed in claim 1, wherein the antenna structure covers a first frequency band, a second frequency band, and a third frequency band, the first frequency band is from 2400 MHz to 2500 MHz, the second frequency band is from 5150 MHz to 5850 MHz, and the third frequency band is from 5925 MHz to 7125 MHz.

5. The antenna structure as claimed in claim 4, wherein the first radiation element substantially has a J-shape, and a length of the first radiation element is from 0.25 to 0.3 wavelength of the first frequency band.

6. The antenna structure as claimed in claim 4, wherein the second radiation element substantially has an inverted J-shape, and a length of the second radiation element is from 0.25 to 0.3 wavelength of the first frequency band.

7. The antenna structure as claimed in claim 4, wherein a distance between the first radiation element and the second radiation element is shorter than 0.25 wavelength of the first frequency band.

8. The antenna structure as claimed in claim 4, wherein the third radiation element substantially has a C-shape, and a length of the third radiation element is from 0.25 to 0.3 wavelength of the second frequency band.

9. The antenna structure as claimed in claim 4, wherein the fourth radiation element substantially has an inverted C-shape, and a length of the fourth radiation element is from 0.25 to 0.3 wavelength of the second frequency band.

10. The antenna structure as claimed in claim 4, wherein the sixth radiation element substantially has a U-shape, and a total length of the fifth radiation element and the sixth radiation element is from 0.2 to 0.25 wavelength of the first frequency band.

11. The antenna structure as claimed in claim 4, wherein the sixth radiation element further comprises a first widening portion.

12. The antenna structure as claimed in claim 4, wherein the seventh radiation element substantially has an L-shape, and a total length of the fifth radiation element and the seventh radiation element is substantially equal to 0.3 wavelength of the second frequency band.

13. The antenna structure as claimed in claim 4, wherein the seventh radiation element further comprises a second widening portion.

14. The antenna structure as claimed in claim 4, wherein the sixth radiation element substantially has an L-shape, and a total length of the fifth radiation element and the sixth radiation element is substantially equal to 0.2 wavelength of the first frequency band.

15. The antenna structure as claimed in claim 4, wherein the seventh radiation element substantially has a straight-line shape, and a total length of the fifth radiation element and the seventh radiation element is substantially equal to 0.2 wavelength of the second frequency band.

16. The antenna structure as claimed in claim 4, further comprising:

an eighth radiation element, having a third feeding point;

a ninth radiation element, coupled to the eighth radiation element; and a tenth radiation element, coupled to the eighth radiation element, wherein the eighth radiation element, the ninth radiation element, and the tenth radiation element are disposed on the second surface of the dielectric substrate.

17. The antenna structure as claimed in claim 16, further comprising:

a signal source; and a switch circuit, coupling the signal source to the first feeding point, the second feeding point, or the third feeding point according to a control signal.

18. The antenna structure as claimed in claim 16, wherein the ninth radiation element substantially has a U-shape, and a total length of the eighth radiation element and the ninth radiation element is from 0.2 to 0.25 wavelength of the first frequency band.

19. The antenna structure as claimed in claim 16, wherein the tenth radiation element substantially has an L-shape, and a total length of the eighth radiation element and the tenth radiation element is substantially equal to 0.3 wavelength of the second frequency band.

20. The antenna structure as claimed in claim 16, wherein the tenth radiation element further comprises a first widening portion and a second widening portion.

* * * * *